United States Patent [19]

Farng et al.

[11] Patent Number: 4,770,799

[45] Date of Patent: Sep. 13, 1988

[54] COPPER SALTS OF HINDERED PHENOL SUBSTITUTED SUCCINIC ANHYDRIDE DERIVATIVES AS ANTIOXIDANT ADDITIVES

[75] Inventors: Liehpao O. Farng; Andrew G. Horodysky, both of Cherry Hill, N.J.

[73] Assignee: Mobil Oil Corporation, New York, N.Y.

[21] Appl. No.: 264

[22] Filed: Jan. 2, 1987

[51] Int. Cl.[4] ..... C10M 129/42

[52] U.S. Cl. ..... 252/35; 252/56 D; 252/400.1; 556/114; 556/115

[58] Field of Search ..... 252/35, 400.1; 556/114, 556/115

[56] References Cited

U.S. PATENT DOCUMENTS

| | | | |
|---|---|---|---|
| 3,146,273 | 8/1964 | Orloff et al. | 252/35 |
| 3,231,587 | 1/1966 | Rense | 252/35 |
| 3,271,310 | 9/1966 | Le Suer | 252/35 |
| 3,935,122 | 1/1976 | Dichert, Jr. | 252/35 |
| 4,552,677 | 11/1985 | Hopkins | 252/35 |

*Primary Examiner*—Jacqueline V. Howard

*Attorney, Agent, or Firm*—Alexander J. McKillop; Michael G. Gilman; Howard M. Flournoy

[57] ABSTRACT

Lubricant compositions containing minor amounts of copper salts of hindered phenol substituted succinic anhydride derivatives possess excellent antioxidant activity.

26 Claims, No Drawings

COPPER SALTS OF HINDERED PHENOL SUBSTITUTED SUCCINIC ANHYDRIDE DERIVATIVES AS ANTIOXIDANT ADDITIVES

BACKGROUND OF THE INVENTION

This invention is directed to copper salts of hindered phenol substituted succinic anhydride derivatives and to lubricant compositions containing minor amounts thereof.

The use of hindered phenols for their antioxidant properties in a variety of products including food materials, rubbers, plastics, and lubricants is well known.

The use of copper carboxylates such as copper oleate has been reportedly useful as an antioxidant, European Pat. No. 92946, and as an engine oil antioxidant, British Pat. No. 2,056,482.

The use of copper salts of succinic anhydride derivatives as effective antioxidants for crankcase lubricants without the deleterious effect on rust and copper/lead bearing corrosion performance that accompanies copper oleate; and the use of carboxylates as antirust and anticorrosion additives in lubricants has been well documented and includes derivatives of oleic acid and oleoyl sarcosine are for example described in European Pat. No. 149,549 and U.S. Pat. No. 4,552,677.

There is an ongoing search for new and better lubricant additives, additives capable of fulfilling the ever-increasing demands of the lubricant art.

It has now been found that the use of the novel copper alkenyl succinic acid derived hindered phenols disclosed herein provide exceptional multifunctional antioxidant activity, with anticorrosion properties. The antioxidant activity demonstrated is greater than that reported for the corresponding copper carboxylates or hindered phenols.

These remarkable benefits are available for a variety of synthetic and mineral oil based lubricants or mixture of mineral and synthetic oils. The lubricant may also be a grease prepared from such oils. To the best of our knowledge, these compositions have not been previously used as antioxidants in lubricating oils, greases or fuels. It is also believed that these additive materials would be highly useful in polymers as stabilizers.

Typical synthetic oils include but are not limited to polyisobutylene, polybutenes, hydrogenated polydecenes, polypropylene glycol, polyethylene glycol, trimethylol propane esters, neopentyl and pentaerythritol esters, di(2-ethylhexyl)sebacate, di(2-ethylhexyl)adipate, dibutyl phthalate, fluorocarbons, silicate esters, silanes, esters of phosphorus-containing acids, liquid ureas, ferrocene derivatives, hydrogenated mineral oils, chain-type polyphenols, siloxanes and silicones (polysiloxanes), alkyl-substituted diphenyl ethers typified by a butyl-substituted bis-(p-phenoxyphenyl)ether, phenoxy phenylether, etc. Mineral oils suitable herein include oils of lubricating viscosity ranging from about 45 SSU at 100° F. to about 250 SSU at 210° F. or any other suitable oil of lubricating viscosity.

DESCRIPTION OF PREFERRED EMBODIMENTS

In accordance with the invention, lubricant compositions containing small additive concentrations of the copper salts of hindered phenol substituted succinic anhydride derivatives, such as the cupric carboxylate salt of the reaction product of dodecenyl succinic anhydride with 4-hydroxymethyl 2,6-di-tert-butylphenol, possess excellent antioxidant activity. Both the hindered phenolic and the copper carboxylate moieties are believed to provide the basis for internal synergistic antioxidant activity. The carboxylate group (linked via the succinate moiety to the hindered phenol) is also believed to contribute additional antirust properties to the additives. These beneficial properties are believed to be enhanced as a result of this novel internal synergism. This internal synergism concept is believed to be applicable to similar structures containing both (a) hindered phenol and (b) copper carboxylate groups within the same molecule. However, we do not wish to be bound by any theory respecting the described benefits. The products in accordance herewith also show good compatibility when other additives are used in the lubricant compositions.

Accordingly, this invention as described briefly hereinabove is directed to compositions and additive products thereof comprising copper salts of hindered phenol *substituted* succinic anhydride derivatives wherein the substituent is a hindered phenol group. The succinic anhydride derivatives generally have long-chain substituted groups in order to improve their solubility in lubricating oils and greases.

Any suitable hindered phenol may be used in the invention. Preferred is 4-hydroxymethyl-2,6-ditertiarybutylphenol.

The succinic anhydride derivatives are preferred hydrocarbon derived succinic anhydride derivatives wherein the hydrocarbon derived group containing from about 6 to about 42 carbon atoms. Such groups include hydrocarbon groups, that is, aliphatic (e.g., alkyl or alkenyl, such as decenyl, isodecenyl, polypropenyl, polyisobutenyl, oligomeric decenyl, trimeric or dimeric decenyl, and the like), alicyclic (e.g., cycloalkyl or cycloalkenyl), aromatic or combinations of such groups, and substituted hydrocarbon groups, that is, radicals containing nonhydrocarbon substituents. Suitable substituents include halo, alkoxy, hydroxy, alkylthio, carbalkoxy, nitro and carboxyl and hetero groups which contain atoms other than carbon present in a chain or ring otherwise composed of carbon atoms, for example, nitrogen, oxygen and sulfur.

Any other suitable dimeric or trimeric acid such as dimeric or trimeric oleic or linoleic acids can be used in place of the hydrocarbyl succinic anhydride or hydrocarbyl succinic acid generating species.

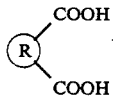

The succinic anhydride groups or compounds include both di-ester and acid-ester groups. Preferred as the succinic anhydride derivative group is the succinic acid group of the formula:

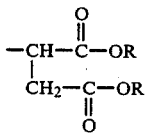

or the group

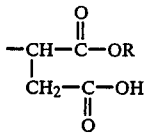

or a mixture of these two groups, where R as above is the hindered phenol with suitable linkage to the ester group.

The substituted succinic anhydride derivative compositions useful for the purposes of this invention contain at least one free carboxylic acid group (i.e., —COOH). Free carboxylic acid groups may be in the substituent group or the succinic anhydride derivative group or in both. Usually, at least one free carboxylic acid group is present in the succinic anhydride derivative group. Preferably, these carboxylic acid groups are present only in the succinic anhydride derivative group.

The substituted succinic anhydrides useful for the purposes of this invention are well known to those of ordinary skill in the art. Typically, the substituted succinic anhydride derivatives useful for the purposes of this invention are derived from substituted succinic anhydrides. Some of these substituted succinic anhydrides are described in U.S. Pat. Nos. 4,324,872; 4,158,664; 4,000,163; 3,819,660; 3,412,111; 3,382,172; and 2,411,215. These patents are hereby incorporated by reference for their teachings of substituted succinic anhydrides and methods for preparing such anhydrides.

The copper ions of the copper salts of this invention can be any of its possible oxidation states, although the most stable oxidation states are preferred, i.e., Cu(I) and Cu(II). The oxidation states are identified by their valence numbers. The oxidation state of +1 is identified by a valence of 1 (e.g., Cu having an oxidation state of +1 has a valence of 1 and is noted by the chemical symbol for copper followed by the (I), Cu(I).

Copper has the oxidation states +1, +2 and +3; however, the oxidation state of +2 is the most stable and therefore the preferred oxidation state.

These salts can be prepared by any method known in the art. The reaction conditions are any set of conditions known in the art to produce the desired results. The specific reaction conditions will vary with the specific reactants. Generally speaking, a two-step process is used. The hindered phenol and the succinic compound may be reacted in less than molar, or more than molar quantities. Preferably in substantially molar quantities at temperatures varying from −20° C. to 250° C., preferably 20° C. to 120° C., pressures ranging from 10 psi to 50 psi or autogenous for 1 hr to 30 hrs. The copper compound and the product thus produced are reacted in less than molar, or substantially molar or greater than molar ratios preferably substantially under ratios of 10 to 1, preferably 1 to 1.

The generalized reaction is as shown in Equation 1.

(Equation 1)

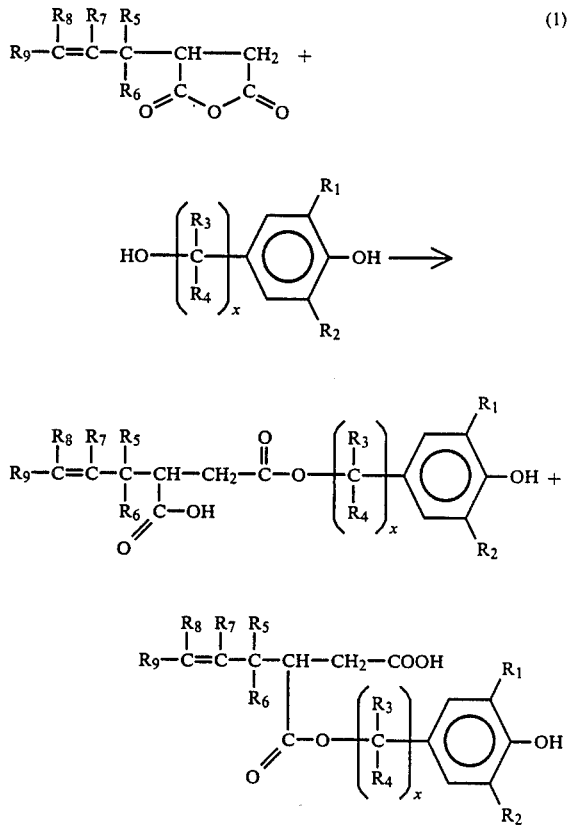

(1)

These substituted succinic acid-ester derivatives are then subsequently converted to their corresponding copper salts by reaction with almost molar quantities, or less than molar quantities, or more than molar quantities of Cu(I) or Cu(II) ions to make neutral, acidic, or basic salts (Equation 2). Generally, the copper compounds used in this invention are selected from cupric acetate hydrate ($Cu(C_2H_3O_2)_2.H_2$), basic cupric acetate ($Cu(C_2H_3O_2)_2$—$CuO.6H_2O$), cupric carbonate ($CuCO_3$), basic cupric carbonate ($CuCO_3$—$Cu(OH)_2$), cuprous hydroxide (CuOH) and cupric hydroxide ($Cu(OH)_2$), and other similar copper compounds.

Equation 2

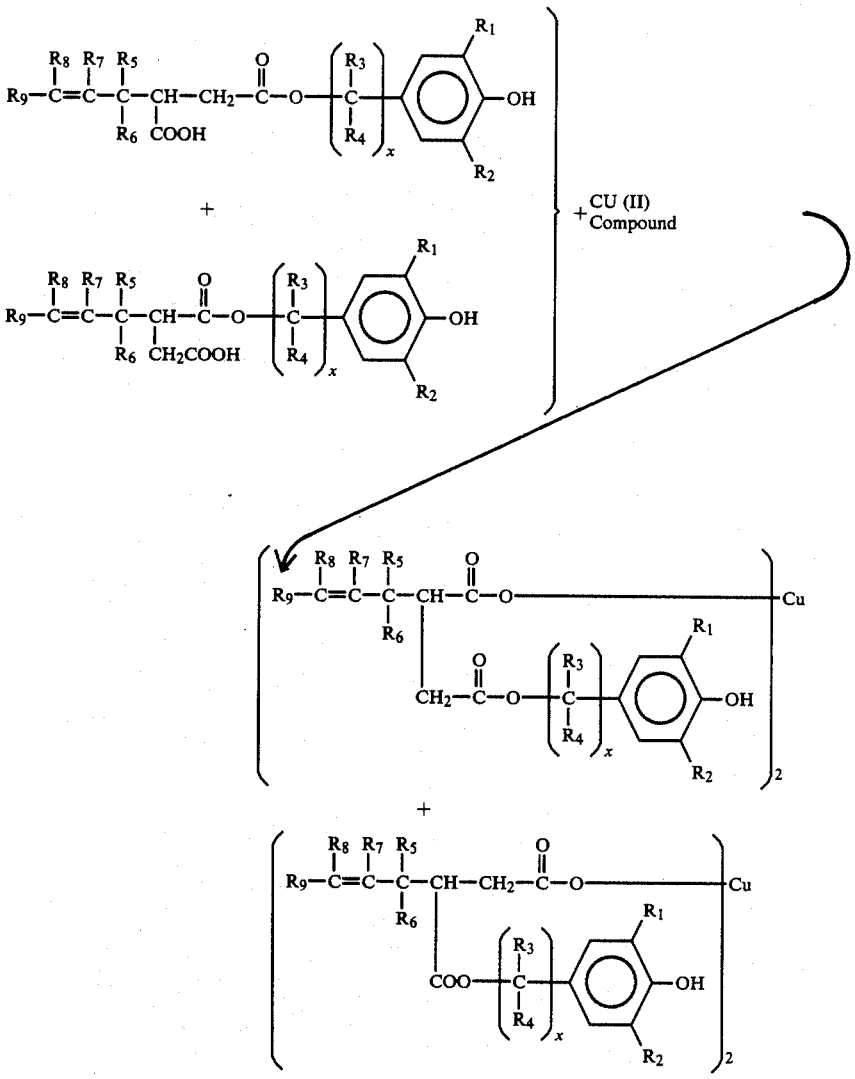

where $R_1$ and $R_2$ are each independently selected from hydrogen, or hydrocarbyl groups containing 1 to about 18 carbon atoms, or tertiary alkyl or aralkyl groups containing from four to about eight carbon atoms with the proviso that both $R_1$ and $R_2$ can not be hydrogen; $R_3$ to $R_8$ inclusive are each independently selected from hydrogen, $C_1$ to about $C_{18}$ hydrocarbyl groups, $C_6$ to about $C_{12}$ aralkyl or cycloalkyl groups and $R_9$ is selected from $C_1$ to about $C_{18}$ hydrocarbyl and X is from 0 to about 4.

EXAMPLE 1

Part A:

Approximately 66.5 g (0.25 mole) of dodecenyl succinic anhydride and 400 ml of benzene were charged to a reaction vessel. This mixture was heated to 80° C. and held at 80°-83° C. under $N_2$ blanket with agitation. A benzene solution of 4-hydroxymethyl 2,6-di-tert-butylphenol (commercial product, 59 g, 0.25 mole, in 800 ml of benzene) was gradually added through a dropping funnel over a course of 8.5 hours. This reaction mixture was further refluxed at 80° C. for two additional hours. The solvent was removed by vacuum distillation, leaving the product as a viscous, yellow liquid.

Part B:

Approximately 125 g of the above product of Example 1, Part A, 1500 ml methanol, and 25 g cupric acetate hydrate (0.125 mole) were reacted at room temperature with agitation for eighteen hours. The volatiles (methanol and acetic acid, etc.) were removed under reduced pressure using a rotary evaporator at the end of the reaction. This gave a greenish, viscous, semi-solid material. It was then washed with water to remove free acids, and finally, it was oven dried to obtain the desired salts with a softening point of 72°-75° C. The product had a deep green color and contained 5.7% of copper (theory, 5.96%).

EXAMPLE 2

Part A:

Approximately 266 g of dodecenyl succinic anhydride, 1500 ml benzene, and 236 g 4-hydroxymethyl 2,6-di-t-butylphenol were reacted as generally described in Example 1, Part A. The reactants were then held at 87°-89° C. for five hours. The solvent was removed by vacuum distillation and this gave 492 g of yellow liquid.

Part B:

Approximately 100.4 g of the above product of Example 2, Part A, 11 g (0.05 mole) basic copper (II) carbonate (obtained commercially), and 600 ml xylene were reacted at 142° C., until water evolution during azeo-tropic distillation ceased. A portion of the solvent was removed by atmospheric distillation at 142°-190° C. Approximately 202 g diluent oil (100 second solvent paraffinic neutral lubricating oil) was added to reduce viscosity and improve handling. The residual solvent was removed by vacuum distillation at 150° C., leaving the product as a dark-brown, viscous material.

EXAMPLE 3

Part A:

Approximately 769 g of polybutenyl succinic anhydride (Mwt: 1538, prepared by the reaction of molar amounts of polybutene, 900 Mwt., and maleic anhydride), 1100 ml benzene, and 118 g 4-hydroxymethyl-2,6-ditertiary-butylphenol (0.5 mole) were reacted as generally described in Example 1, Part A. After about five hours, addition of phenols was completed, the reactants were then held at 83°-85° C. for six hours. The solvent was removed by vacuum distillation, leaving the product as a viscous, reddish liquid.

Part B

Approximately 184 g of the above product of Example 3, Part A, 226 g toluene, and 5.5 g of basic copper (II) carbonate (0.025 mole) were reacted at up to 80° C., under atmospheric pressure for five hours. The solvent was removed under reduced pressure using a rotary evaporator. This gave a light green product containing 1.7% of copper (theory, 1.7%).

The products of the examples were blended into fully formulated oils and evaluated by Catalytic Oxidation Test at 325° F. for forty hours (Table 1); at 260° F. for eighty hours (Table 2); and at 375° F. for twenty-four hours (Table 3). The test lubricant compositions were subjected to a stream of air which is bubbled through the composition at a rate of 5 liters per hour at the above indicated temperatures and times. Present in the composition are metals commonly used as materials of engine construction, namely:

(a) 15.6 sq. in. of sand-blasted iron wire,
(b) 0.78 sq. in. of polished copper wire,
(c) 0.87 sq. in. of polished aluminum wire, and
(d) 0.167 sq. in. of polished lead surface.

Inhibitors for oil are rated on the basis of prevention of oil deterioration as measured by the increase (change) in acid formation or neutralization number (NN) and kinematic viscosity (KV) change in viscosity occasioned by the oxidation. Other data may also be obtained as disclosed in Table 3. A comparison of the oxidation-inhibiting characteristics of the inventive products in fully formulated oils is in Tables 1, 2 and 3.

TABLE 1

| Antioxidant Evaluation (325° F.-40 hrs.) | | | | |
|---|---|---|---|---|
| Item | Additive Conc. (Wt. %) | Sludge Rating | Change in Acid Value | % Change in Viscosity |
| Base Oil (150 second, fully formulated, solvent refined paraffinic bright oil containing defoamant/demulsifier/antiwear/anticorrosion/EP/antirust performance package) | — | Nil | 2.58 | 30.61 |
| Cupric Salt (Example 1) | 0.1 | Trace | 0.84 | 26.66 |
| Cupric Salt (Example 2) | 0.2 | Nil | 2.21 | 26.60 |
| 2,6-di-tert-butyl-p-cresol | 0.1 | Trace | 2.16 | 29.59 |
| | 0.5 | Trace | 1.82 | 32.35 |
| 2,6-di-tert-butylphenol | 0.1 | Trace | 1.67 | 31.34 |
| | 0.5 | Moderate | 1.34 | 30.70 |

TABLE 2

| Antioxidant Evaluation (260° F.-80 hrs.) | | | |
|---|---|---|---|
| Item | Additive Conc. (Wt. %) | Sludge Rating | % Change in Viscosity |
| Base Oil (fully formulated mineral oil) | — | Nil | 6.48 |
| Cupric Salt (Example 1) | 0.1 | Nil | 3.95 |
| 2,6-di-tert-butyl-p-cresol | 0.1 | Nil | 6.60 |
| | 0.5 | Nil | 7.26 |
| 2,6-di-tert-butylphenol | 0.1 | Trace | 7.55 |
| | 0.5 | Trace | 8.33 |

As little as 0.1% in a fully formulated mineral oil based gear oil of the product of Example 1 controls the increase in viscosity of the test oil much better than equal or greater concentrations of more traditional hindered phenolic antioxidants as shown in Table 1 and 2.

TABLE 3

| Antioxidant Evaluation - (375° F.-24 hrs) | | | | | | | |
|---|---|---|---|---|---|---|---|
| Item | Additive Conc. (Wt. %) | KV at 100° C. New Oil | Acid Number New Oil | KV at 100° C. Used Oil | Acid Number Used Oil | Change in Viscosity KV | in Acid Number |
| Base Oil (Fully formulated mineral oil) | — | 29.06 | 1.15 | 80.74 | 7.68 | 177.9 | 6.53 |
| Cupric Salt (Example 2) | 0.2 | 29.02 | 1.31 | 62.77 | 5.91 | 116.3 | 4.60 |
| Cupric Salt | 1.0 | 29.73 | 1.88 | 64.67 | 7.82 | 117.5 | 5.94 |

TABLE 3-continued

| | | Antioxidant Evaluation - (375° F.-24 hrs) | | | | | |
|---|---|---|---|---|---|---|---|
| Item | Additive Conc. (Wt. %) | KV at 100° C. New Oil | Acid Number New Oil | KV at 100° C. Used Oil | Acid Number Used Oil | Change in Viscosity KV | in Acid Number |
| (Example 3) | | | | | | | |

The products of Examples 2 and 3 also show excellent control of oxidative stability in the fully formulated mineral oil based gear oil in high temperature applications as shown in Table 3.

The use of additive concentrations of copper succinate derived hindered phenols in accordance with the invention in premium quality automotive and industrial lubricants significantly enhance their stability and extend their service life. These novel compositions are useful at low concentrations and do not contain any potentially undesirable phosphorus or sulfur. These multifunctional antioxidants can be commercially made using economically favorable processes using known technology in existing equipment.

Although the present invention has been described with preferred embodiments, it is to be understood that modifications and variations may be resorted to, without departing from the spirit and scope of this invention, as those skilled in the art will readily understand. Such modifications and variations are considered to be within the purview and scope of the appended claims.

What is claimed is:

1. An additive product comprising a copper salt of a hindered phenol substituted succinic anhydride or acid wherein the substituted substituent is a hindered phenol group and wherein said derivative contains from 6 to about 42 carbon atoms.

2. The product of claim 1 wherein the succinic anhydride or acid derivative is a hydrocarbon derived group wherein the hydrocarbon group is selected from decenyl, isodecenyl, polypropenyl, polyisobutenyl, oligomeric decenyl and trimeric or dimeric decenyl.

3. The product of claim 1 wherein said succinic anhydride or acid group is selected from both diester and acid-ester groups.

4. The product of claim 3 wherein said succinic anhydride or acid is selected from

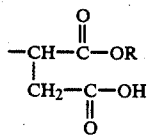

or

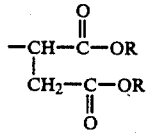

or a mixture of these groups where R is a hindered phenol linked to the ester group.

5. The product of claim 1 wherein said hindered phenol has the following general structure

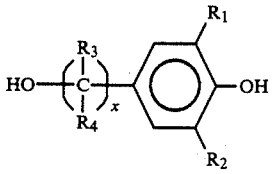

wherein $R_1$ and $R_2$ are each independently selected from H, $C_1$ to about $C_{18}$ hydrocarbyl or $C_4$ to about $C_8$ t-alkyl or aralkyl with the proviso that $R_1$ and $R_2$ both cannot be H; $R_3$ and $R_4$ are each independently selected from H, $C_1$ to about $C_{18}$ hydrocarbyl, $C_6$ to about $C_{12}$ aralkyl or cycloalkyl and x is 0 to about 4.

6. The product of claim 1 wherein the copper salt is derived from the group consisting of cupric acetate hydrate, basic cupric acetate, cupric carbonate, basic cupric carbonate, cuprous hydroxide and cupric hydroxide.

7. The product of claim 1 wherein the copper salt has a valence of +2.

8. The product of claim 1 wherein the copper salt is cupric acetate hydrate.

9. The product of claim 1 wherein the copper salt is basic copper (II) carbonate.

10. A lubricant composition comprising a major proportion of an oil of lubricating viscosity or grease prepared therefrom and a minor antioxidant amount of an additive product comprising a copper salt of a hindered phenol substituted succinic anhydride or acid derivative wherein the substituted substitutent is a hindered phenol group and wherein said derivative contains from 6 to about 42 carbon atoms.

11. The lubricant composition of claim 10 wherein said succinic anhydride or acid derivative is a hydrocarbon selected from the group consisting of decenyl, isodecenyl, polypropenyl, polyisobutenyl, oligomeric decenyl and trimeric or dimeric decenyl.

12. The lubricant composition of claim 10 wherein said succinic derivative is selected from

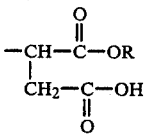

or

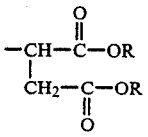

or a mixture of these groups where R is a hindered phenol linked to the ester group.

13. The lubricant composition of claim 10 wherein said hindered phenol has the following general structures

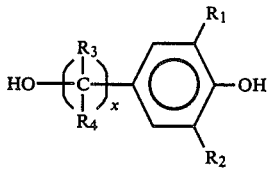

wherein $R_1$ and $R_2$ are each independently selected from H, $C_1$ to about $C_{18}$ hydrocarbyl or $C_4$ to about $C_8$ t-alkyl or aralkyl with the proviso that $R_1$ and $R_2$ both cannot be H; $R_3$ and $R_4$ are each independently selected from H, $C_1$ to about $C_{18}$ hydrocarbyl, $C_6$ to about $C_{12}$ aralkyl or cycloalkyl and x is 0 to about 4.

14. The lubricant composition of claim 10 wherein the product contains a copper salt derived from the group consisting of cupric acetate hydrate, basic cupric acetate, cupric carbonate, basic cupric carbonate, cuprous hydroxide and cupric hydroxide.

15. The lubricant composition of claim 10 wherein the product contains a copper salt derived from cupric acetate hydrate.

16. The lubricant composition of claim 10 wherein the product contains a copper salt derived from basic copper (II) carbonate.

17. The composition of claim 10 wherein said oil of lubricating viscosity is selected from mineral oils, synthetic oils and mixtures of mineral and synthetic oils.

18. The composition of claim 17 wherein said oil of lubricating viscosity is a mineral oil.

19. The composition of claim 17 wherein said oil of lubricating viscosity is a synthetic oil.

20. The composition of claim 17 wherein said oil of lubricating viscosity is a grease.

21. A process of making a copper alkenyl succinic acid product derived from a hindered phenol comprising:

(1) first reacting in substantially molar quantities a hydroxyalkyl hindered phenol and a substituted succinic acid derivative;

(2) secondly reacting in substantially molar quantities the product of (1) and a copper I or copper II ions for a time sufficient and under reaction conditions suitable to obtain the desired internally synergistic product.

22. The process of claim 21 wherein the first reaction has temperatures varying from −20° to about 250° C., pressures varying from 10 psi to about 50 psi; and the second reaction has temperatures varying from −20° to 250° C. and pressures varying from 0 psi to about 50 psi.

23. The product of claim 1 comprising a copper salt of a dimeric or trimeric acid derivative.

24. The product of claim 10 comprising a copper salt of a dimeric or trimeric acid derivative.

25. The product of claim 23 wherein said dimeric or trimeric acid derivative is selected from dimeric or trimeric oleic or linoleic acids.

26. The lubricant composition of claim 25 wherein said derivative is selected from dimeric or trimeric oleic or linoleic acids.

* * * * *